US009194359B2

(12) United States Patent
Steinberger

(10) Patent No.: US 9,194,359 B2
(45) Date of Patent: Nov. 24, 2015

(54) IGNITION COIL, SPARK PLUG, AND IGNITION SET-UP INCLUDING AN IGNITION COIL AND SPARK PLUG

(75) Inventor: Werner Steinberger, Immenstadt (DE)

(73) Assignee: ROBERT BOSCH GMBH, Stuttgart (KR)

( * ) Notice: Subject to any disclaimer, the term of this patent is extended or adjusted under 35 U.S.C. 154(b) by 819 days.

(21) Appl. No.: 13/387,486

(22) PCT Filed: Jul. 12, 2010

(86) PCT No.: PCT/EP2010/059994

§ 371 (c)(1),
(2), (4) Date: Apr. 3, 2012

(87) PCT Pub. No.: WO2011/015427

PCT Pub. Date: Feb. 10, 2011

(65) Prior Publication Data

US 2012/0186568 A1 Jul. 26, 2012

(30) Foreign Application Priority Data

Aug. 3, 2009 (DE) ..... 10 2009 035 897

(51) Int. Cl.

| | |
|---|---|
| ***H01T 13/04*** | (2006.01) |
| ***F02P 13/00*** | (2006.01) |
| ***H01T 13/40*** | (2006.01) |
| ***H01T 13/41*** | (2006.01) |

(Continued)

(52) U.S. Cl.

CPC ..... *F02P 13/00* (2013.01); *H01F 38/12* (2013.01); *H01T 13/04* (2013.01); *H01T 13/40* (2013.01); *H01T 13/41* (2013.01); *H01T 13/44* (2013.01); *F02D 2400/22* (2013.01); *F02P 3/02* (2013.01); *H01R 13/2421* (2013.01)

(58) Field of Classification Search

CPC ..... H01T 13/04; H01T 13/40; H01T 13/41; F02P 3/02; F02P 13/00

USPC ..... 123/143 C, 634, 635; 313/51, 135; 336/107; 439/125, 127

See application file for complete search history.

(56) References Cited

U.S. PATENT DOCUMENTS 1,996,421 A * 4/1935 Hurley ..... 174/152 S
2,266,614 A 12/1941 Robinson (Continued)

FOREIGN PATENT DOCUMENTS

CN 201130816 10/2008
DE 100 07 545 3/2001

(Continued)

OTHER PUBLICATIONS

International Search Report for PCT/EP2010/059994, dated Jul. 7, 2011.

*Primary Examiner* — Erick Solis
(74) *Attorney, Agent, or Firm* — Kenyon & Kenyon LLP

(57) ABSTRACT

In an ignition coil having a high-voltage terminal and a spring for electrically connecting the high-voltage terminal to a spark plug, a contact segment of the spring, which is directed towards the spark plug, has an outer circumference that is reduced in comparison with an outer circumference of further segments of the spring. The spark plug has a contact region for contacting with the spring of the ignition coil, which contact region has a recess surrounded by a closed, annular wall region for receiving the contact segment of the spring of the ignition coil.

24 Claims, 4 Drawing Sheets

(51) Int. Cl.

| | |
|---|---|
| ***H01F 38/12*** | (2006.01) |
| ***H01T 13/44*** | (2006.01) |
| *F02P 3/02* | (2006.01) |
| *H01R 13/24* | (2006.01) |

(56) References Cited

U.S. PATENT DOCUMENTS

| | | | | |
|---|---|---|---|---|
| 2,321,782 | A | 6/1943 | Von Mertens | |
| 2,365,219 | A | 12/1944 | Rose | |
| 4,621,881 | A | 11/1986 | Johansson et al. | |
| 5,258,684 | A * | 11/1993 | Matesco | 313/141 |
| 5,340,323 | A * | 8/1994 | Imanishi et al. | 439/125 |
| 5,487,676 | A | 1/1996 | Maruyama et al. | |
| 5,632,636 | A * | 5/1997 | Maekawa | 439/125 |
| 5,682,865 | A | 11/1997 | Maekawa et al. | |
| 5,685,282 | A | 11/1997 | Murata et al. | |
| 5,749,742 | A | 5/1998 | Bertuzzi, Jr. et al. | |
| 5,827,079 | A | 10/1998 | Murata | |
| 6,247,943 | B1 * | 6/2001 | Moga et al. | 439/125 |
| 6,340,303 | B2 * | 1/2002 | Hamada et al. | 439/127 |
| 6,443,137 | B1 * | 9/2002 | Kraft et al. | 123/634 |
| 6,668,810 | B1 | 12/2003 | St. John et al. | |
| 6,880,540 | B2 | 4/2005 | Fuma et al. | |
| 7,019,448 | B2 * | 3/2006 | McMurray et al. | 313/141 |
| 7,059,926 | B2 * | 6/2006 | McMurray et al. | 445/7 |
| 8,066,520 | B2 * | 11/2011 | Lenfert et al. | 439/125 |
| 2001/0045800 | A1 * | 11/2001 | Hamada et al. | 313/625 |

FOREIGN PATENT DOCUMENTS

| | | |
|---|---|---|
| DE | 102 33 368 | 1/2004 |
| DE | 10 2007 026 669 | 1/2009 |
| EP | 0 478 411 | 4/1992 |
| EP | 0 713 006 | 5/1996 |
| FR | 79 484 | 12/1962 |
| GB | 371 892 | 4/1932 |
| JP | 43022771 | 9/1943 |
| JP | 57-040375 | 9/1982 |
| JP | 4-322771 A | 11/1992 |
| JP | 5-343155 | 12/1993 |
| JP | 6-147084 | 5/1994 |
| JP | 6-147086 | 5/1994 |
| JP | 8-236261 | 9/1996 |
| JP | 8-288028 | 11/1996 |
| JP | 2001-85139 | 3/2001 |
| JP | 2002-227755 | 8/2002 |
| JP | 2008-95631 | 4/2008 |
| JP | 2009-127657 | 6/2009 |
| WO | WO 2008/148765 | 12/2008 |

* cited by examiner

IGNITION COIL, SPARK PLUG, AND IGNITION SET-UP INCLUDING AN IGNITION COIL AND SPARK PLUG

BACKGROUND OF THE INVENTION

1. Field of the Invention

The present invention relates to an ignition coil, a spark plug, as well as an ignition set-up including an ignition coil and a spark plug.

2. Description of Related Art

Various embodiments of ignition coils, spark plugs, as well as ignition set-ups made up of these are known from the related art. For example, published German patent application document DE 10 2007 026 669 A1 shows an ignition coil having a high-voltage terminal and a spring for electrically connecting the high-voltage terminal to a spark plug, where the spring is surrounded by a protective sheath. Thus, a contact between the spring and a contact region of the spark plug is formed in such a manner, that the spring has a conically widening contact segment, which is put over a contact region of the spark plug. Such spark plugs have fundamentally proven their worth, but the spaces of modern engines are becoming more and more confined. Thus, one option would be to reduce a diameter of a plug shaft. However, the sharp-edged end of the spring disadvantageously produces an increase in field strength between the end of the spring and the plug shaft. Due to higher voltage requirements at this position, this may result in electrical breakdowns, which, however, must be absolutely avoided. Therefore, it would be desirable to have an improved connection between a spark plug and an ignition coil, which, in particular, takes up less space.

BRIEF SUMMARY OF THE INVENTION

The ignition coil of the present invention has the advantage that it allows simple and reliable contacting of a spark plug and, with that, may be manufactured in a particularly simple and cost-effective manner. In addition, the ignition coil of the present invention ensures that, in particular, in the region of the contacting with the spark plug, only a very small space is necessary, in particular, in a radial direction of a spring of the ignition coil. Furthermore, reliable shielding of a contact segment at the end of the spring of the ignition coil may be rendered possible. According to the present invention, this is achieved in that the ignition coil has a contact segment of the spring directed towards the spark plug, the contact segment of the spring having a reduced outer diameter in comparison with an outer diameter of the rest of the spring. In this manner, the reduced outer diameter of the contact segment may be shielded highly effectively in the radial direction from the cylinder head connected to ground. The shielding is preferably achieved with the aid of a recess provided in a contact region of the spark plug, the recess having an annularly encircling wall region, which, in the assembled state of the ignition coil, receives and shields the reduced-circumference contact segment of the spring.

The spring contact segment having a reduced outer diameter is preferably tapered, in particular, conically tapered. In this manner, the tapered contact segment of the spring has an additional centering effect during the mounting of the ignition coil on a spark plug. Furthermore, the tapered region additionally ensures that in the assembled state, the spring is effectively fixed in position, so that, for example, in the event of vibrations in the engine, less wear occurs due to decreased movement of the tapered contact segment of the spring. When the contact segment of the spring is conically formed, the contact segment has a substantially frustoconical enveloping surface; the frustoconical enveloping surface preferably being formed to have an opening angle between 40° and 60°, especially 50°.

Alternatively, the reduced-circumference contact segment of the spring is substantially cylindrical, having a smaller outer diameter than an outer diameter of the further segments of the spring. Improved shielding of the contact segment of the spring may also be achieved by this means, and in addition, a particularly secure seating of the contact segment in a correspondingly formed recess of the spark plug may be obtained.

In order to have as little range of motion as possible in the contact segment of the spring, the contact segment of the spring is preferably set up so as to prevent compressive movement, i.e., adjacent windings at the contact segment of the spring are in contact with one another.

In addition the present invention relates to a spark plug including a contact region for a contact with a spring of an ignition coil. The contact region of the spark plug has a recess, which is surrounded by a closed, annular wall region. The recess is used for receiving a contact segment of the spring of the ignition coil, and the wall region provides shielding of the contact segment of the spring in the radial direction. An opening of the recess at the spark plug is directed preferably perpendicularly to a center line of the spring, in order to allow the spring to be received in the recess in a secure and simple manner. Consequently, the provision of the recess in accordance with the present invention may allow highly cost-effective and reliable shielding of the end of the spring to be achieved, which means that unwanted increases in electric field strength at the end of the spring do not occur. In this context, in particular, space may be saved in the radial direction of the spark plug, which means that, e.g., a bore in a cylinder head for the spark plug may be formed with a smaller diameter.

Preferably, the recess is tapered in a direction of a center line of the spark plug, in order to allow a contact segment of the spring of the ignition coil to be easily located. The tapering of the recess is preferably conical, in particular, at an opening angle of 40° to 60°, and especially at an opening angle of 50°. Alternatively, the recess at the contact region of the spark plug may be formed cylindrically, so that the recess may also be produced in a simple and cost-effective manner. According to a further alternative, the contact segment may take the form of a spherical segment or a parabolic segment.

The recess also preferably has a depth, which is equal to or greater than a diameter of a spring wire of the spring of the ignition coil. In this manner, it is ensured that at least one complete winding of the end of the spring is situated in the recess of the spark plug. However, the depth of the recess is preferably selected so that at least two complete windings of the spring may be accommodated. Preferably, the wall region surrounding the recess also has a minimum thickness that corresponds to one wire diameter of the spring.

In order to allow particularly reliable contacting between the spring of the ignition coil and the spark plug, the recess has a circular base region. By this means, the last winding of the spring may be supported securely at the base region of the recess. In this context, it is further preferable for a transition from the base region to the wall region of the recess to be rounded off. It is particularly preferable for the rounded-off area to be selected to have a radius that corresponds to a radius of the spring wire of the ignition coil. The radius is preferably between 0.3 and 0.5 mm, particularly preferably 0.4 mm. It is further preferable for the depth of the recess to be less than a radius of the base region. By this means, it may be ensured that the contact region of the spark plug does not become too long in the axial direction. Alternatively, the transition between the base region and the wall region may also be sharp-edged.

Furthermore, the present invention relates to an ignition set-up including a spark plug according to the present invention and/or an ignition coil according to the present invention. The spark plug has a contact region that includes a recess, which is surrounded by an annularly closed wall region. The ignition coil includes a spring having a contact segment, which is situated in the recess of the spark plug. In this manner, the ignition set-up of the present invention has excellent contacting between the end of the spring and the spark plug, and in addition, the contact segment of the spring is securely accommodated in the recess. In this context, contacting between the end of the spring and the spark plug may take place via both a base region of the recess and the surrounding wall region. By this means, improved contacting is achieved, and on the other hand, the spark-plug wall region surrounding the end of the spring ensures shielding. In this context, the space of the ignition set-up of the present invention is not increased in the radial direction of the spark plug, but may preferably be designed to be even smaller. By this means, in particular, more stringent space requirements in modern engines may be adhered to, and correspondingly necessary bores in a cylinder head for the spark plug and ignition coil may be reduced in size.

The ignition set-up of the present invention is preferably constructed in such a manner, that a shape of the recess of the spark plug is complementary to an enveloping surface of the contact surface of the ignition-coil spring. By this means, the shape of the recess and the shape of the contact segment of the spring correspond to one another, which means that the two contact regions of the spark plug and the ignition coil are shaped to match one another. In addition to simplifying assembly, this also simplifies the contacting between the two components. Alternatively, the enveloping surfaces of the recess and the contact segment may not be complementary to one another, e.g., the contact segment may be cylindrical, and the recess may be conical.

A depth of the recess in an axial direction is preferably at least equal to or greater than a wire diameter of the spring of the ignition coil. It is preferred that the depth of the recess be two to three times greater than the wire diameter of the spring. It is further preferred that a thickness of the wall region be equal to or greater than the wire diameter of the spring. The depth of the recess in the axial direction is preferably between 1.2 mm and 1.6 mm, especially 1.5 mm. The diameter of the spring wire is preferably between 0.5 and 0.8 mm and is, particularly preferably, 0.6 mm.

According to a further preferred refinement of the present invention, the contact segment of the spring exclusively contacts the wall region of the spark plug. This may ensure minimum wear, and contacting at only one point becomes possible.

DETAILED DESCRIPTION OF THE INVENTION

An ignition set-up 1 having an ignition coil 2 and a spark plug 3 according to a first exemplary embodiment of the present invention is described below with reference to FIGS. 1 through 3.

Figure 1:
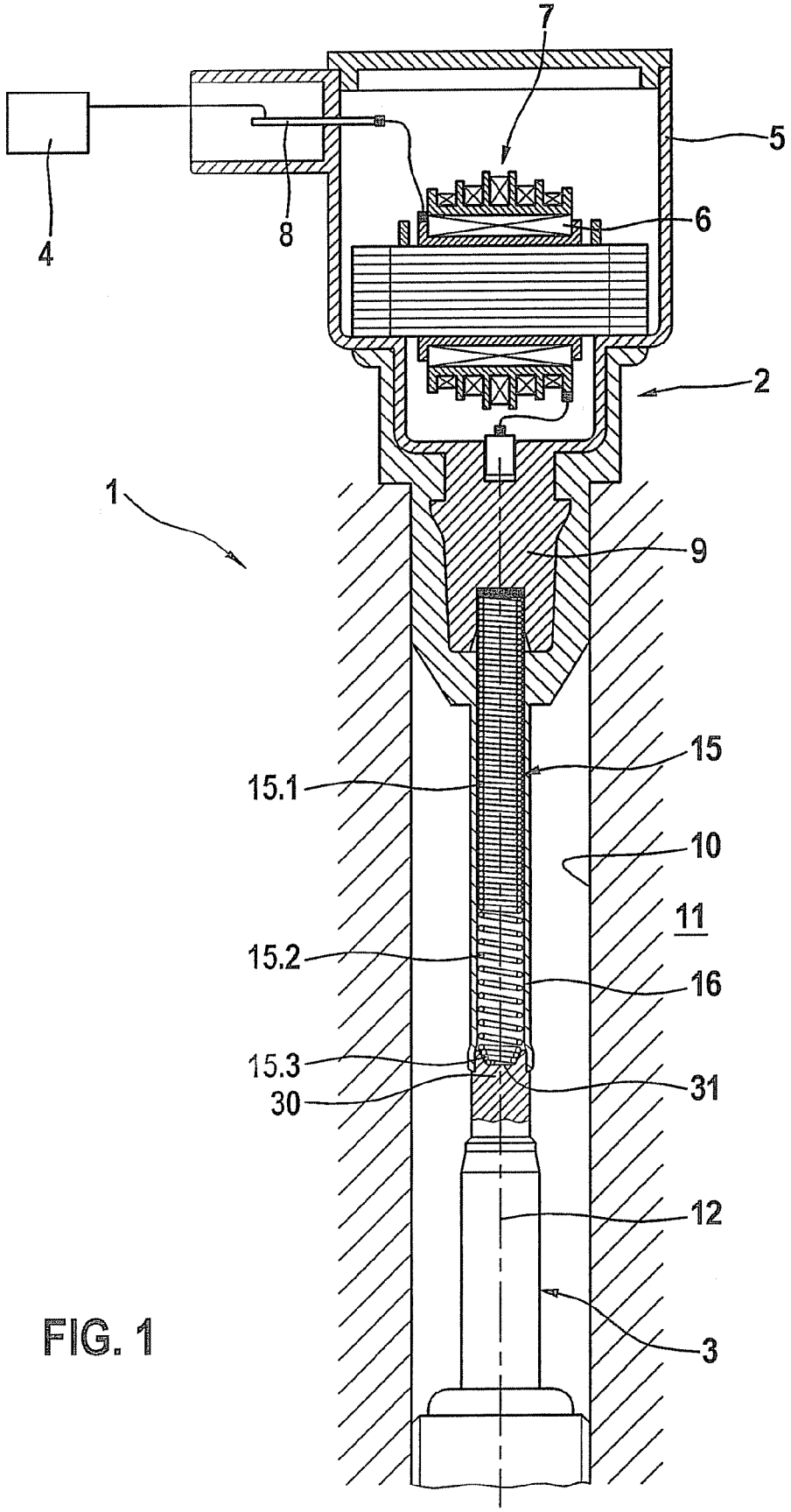
FIG. 1 shows a schematic sectional view of an ignition set-up according to a first exemplary embodiment of the present invention.

As is apparent from FIG. 1, ignition coil 2 includes a coil housing 5, in which a primary coil 6 and a secondary coil 7 interact in such a manner, that a high voltage for spark plug 3 is produced from a low d.c. voltage of a battery 4. Primary coil 6 is electrically connectable to battery 4 via a low-voltage terminal 8, and to spark plug 3 via a high-voltage terminal 9. Spark plug 3 is situated in a shaft 10 of a cylinder head 11 of an internal combustion engine. A center line of the spark plug and the ignition coil is designated by reference numeral 12.

As a contact element, ignition coil 2 further includes a spring 15 that is surrounded by an insulating protective sheath 16. In this context, the insulating protective sheath surrounds both high-voltage terminal 9 and a contact region 30 of spark plug 3. Contact region 30 is the region of spark plug 3 that is pointed towards ignition coil 3 in the direction of longitudinal axis 12. As is apparent from FIGS. 2 and 3, contact region 30 of the spark plug has a recess 31, which is situated at the extreme end of contact region 30. Recess 31 has a base region 33 and a wall region 32 annularly surrounding the base region 33 completely. As is apparent from FIG. 3, starting out from the opening of recess 31, wall region 32 is tapered in the direction of base region 33. In particular, recess 31 is conically tapered, an opening angle $\alpha$ of the tapering being 50°. In addition, a supporting shoulder 34 directed radially outward is formed on contact region 30 of the spark plug, the supporting shoulder forming a support for protective sheath 16, as is apparent from FIG. 2.

Figure 2:
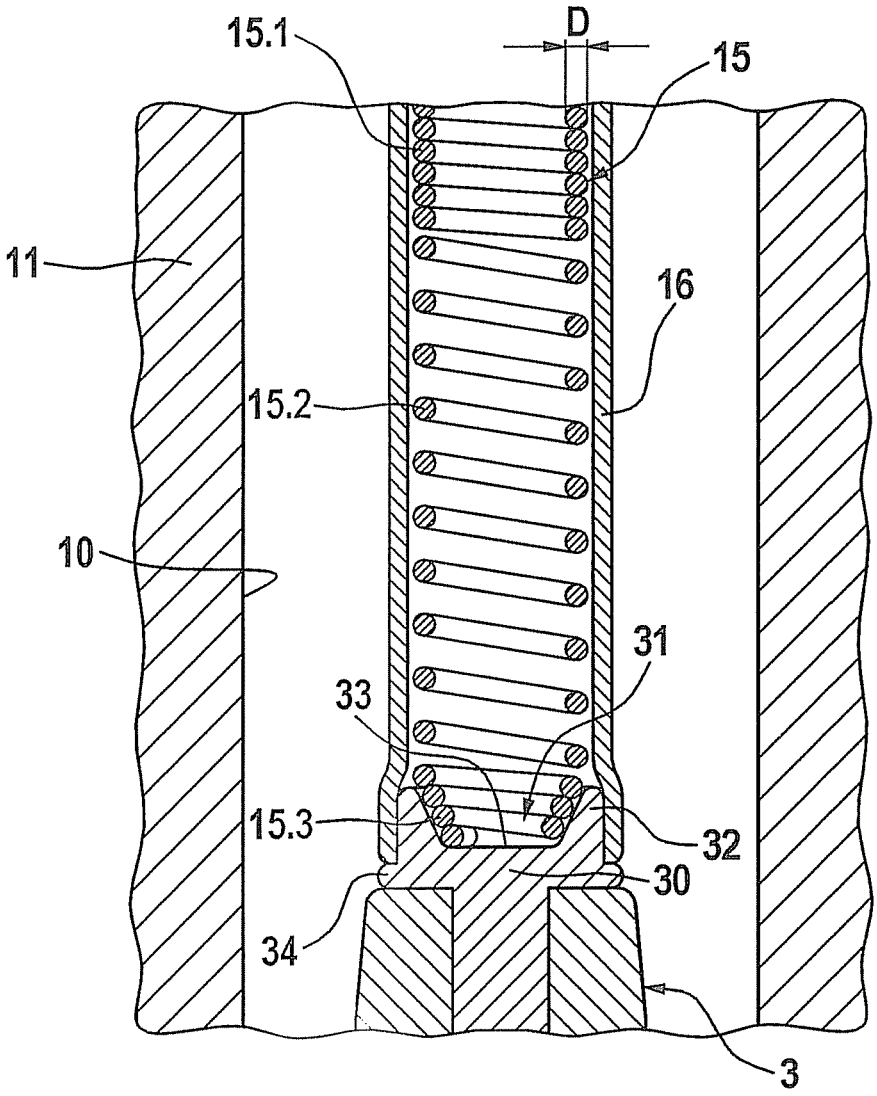
FIG. 2 shows an enlarged view of a contacting region between an ignition coil and a spark plug of the ignition set-up of FIG. 1.

As is further apparent from FIGS. 1 and 2, spring 15 has three main segments, namely, a first non-compressible segment 15.1, a spring segment 15.2 and a contact segment 15.3. In this context, non-compressible segment 15.1 is many times longer than spring segment 15.2 and contact segment 15.3 together. As an alternative, non-compressible segment 15.1 may be omitted, and the segment may instead be completely formed as a spring segment. In this connection, a pitch of the spring segment may also change over the length. As is apparent from FIG. 2, contact segment 15.3 is also tapered in the direction of its end. In this exemplary embodiment, tapered contact segment 15.3 includes exactly three windings of spring 15. Consequently, contact segment 15.3 forms a substantially frustoconical end of the spring that is formed for contacting with spark plug 3. In this context, an opening angle of the taper of contact segment 15.3 corresponds to opening angle $\alpha$ of wall region 32 of recess 31 at the spark plug. The last winding of contact segment 15.3 of the spring may touch base region 33, but the contact segment rests securely against circumferential wall region 32 of recess 31. In this connection, a single point of contact between the contact segment and the wall region is sufficient. In the exemplary embodiment, the second and third windings of contact segment 15.3 touch wall region 32. By this means, particularly effective contacting between contact segment 15.3 and contact region 30 of the spark plug is achieved. In addition, the windings of contact segment 15.3 are formed to be non-compressible, i.e., to touch one another, which provides improved contacting and produces a certain increase in the rigidity of contact segment 15.3 of the spring. Furthermore, wall region 32 provides circumferential shielding for the end of the spring, which means that excellent shielding from increases in electric field strength is present in the region of the sharp-edged end of the spring. In this context, an outer circumference of contact region 30 is not larger than in the case of conventional spark plugs, but on the contrary, may be formed to be smaller. By this means, space for the shielding of the end of the spring may be saved, and consequently, shaft 10 may have a reduced diameter.

Therefore, according to the present invention, the spark plug, in particular, wall region 32 at contact region 30 of the spark plug, provides the shielding for the end of the spring, which means that further, additional components are not necessary. Furthermore, a length of contact region 30 of the spark plug in the axial direction may be reduced, so that by this means, a reduction in space in the axial direction results. In addition, material is saved at contact region 30 of the spark plug. This further reduces the cost of the spark plug. Alternatively, this region may be used for an extended insulator region. In addition, cone-shaped recess 31 ensures that contact segment 15.3 is located more easily during assembly, and additionally allows contact segment 15.3 to be fixed in position in recess 31 in an improved manner in the event of vibrations of the internal combustion engine. The result of this is reduced wear and, consequently, an increased service life of the contacting between the ignition coil and spark plug. Consequently, the approach of the present invention for contacting between the spark plug and the ignition coil provides a significant improvement, which may be implemented in a simple and cost-effective manner. Furthermore, the provision of supporting shoulder 34 may also allow protective sheath 16 to be fixed in position at spark plug 3 in a simple manner.

Figure 3:
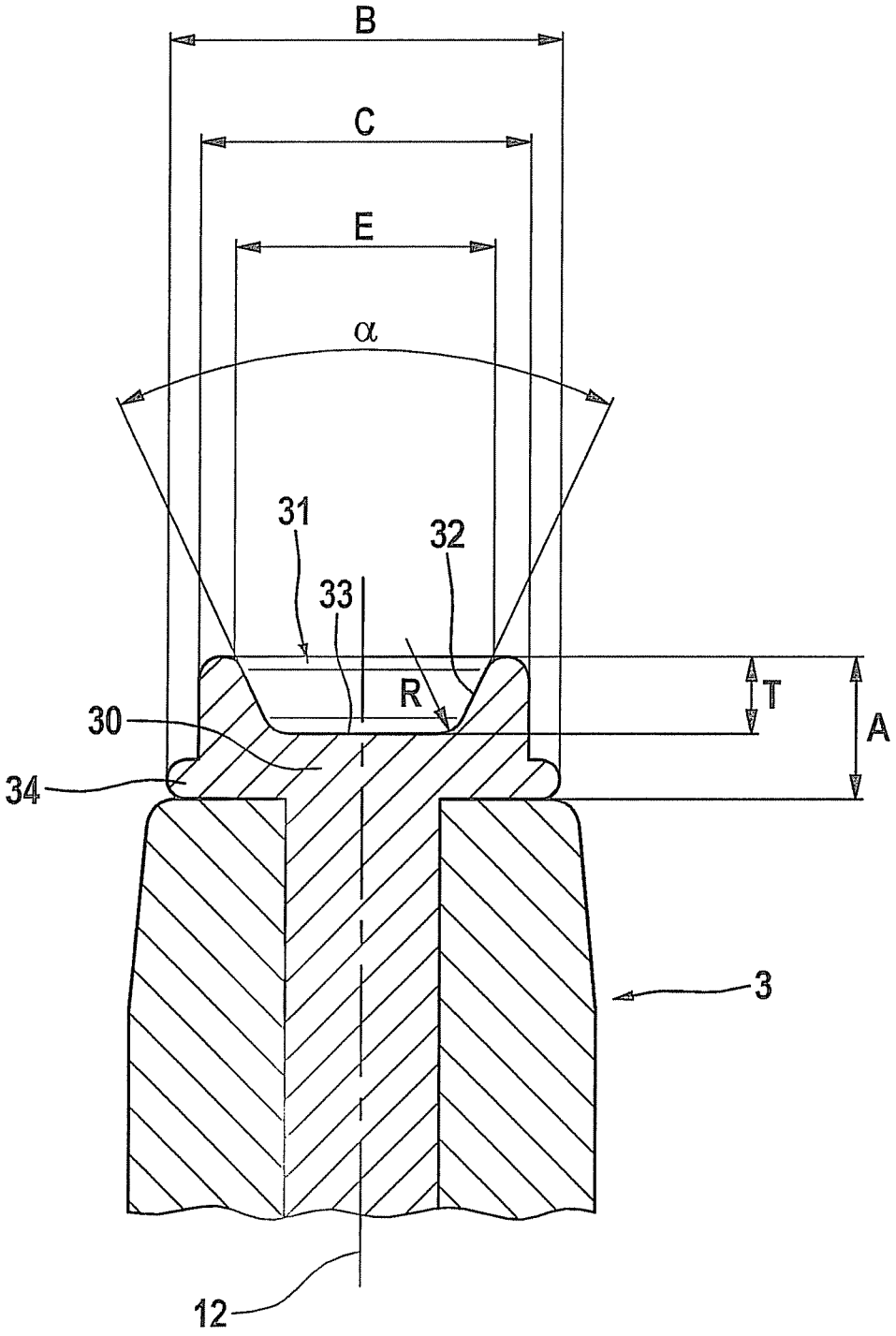
FIG. 3 shows an enlarged view of a contact region of the spark plug.

FIG. 3 shows contact region 30 of spark plug 3 in detail, a depth T of recess 31 being approximately 3 times a wire diameter D (FIG. 2). In this exemplary embodiment, the depth is 1.5 mm; contact region 30 having an overall thickness A of 2.8 mm in the axial direction. A maximum outer diameter B at supporting shoulder 34 is 7.7 mm, an outer diameter C of wall region 32 is 6.4 mm and a diameter E at the opening of recess 31 is 5 mm. In addition, a transition between the inner wall surface of wall region 32 and base region 33 is provided with a radius R, wall region 32 also being rounded off at the opening of recess 31, so that, in particular, contact segment 15.3 of the spring may be easily inserted and protective sheath 16 may also be slipped over wall region 32 in a simple manner. This allows particularly simple assembly.

A second exemplary embodiment of the present invention is described below in detail, with reference to FIG. 4, the same or functionally equal parts being designated by the same reference numerals as in the first exemplary embodiment.

Figure 4:
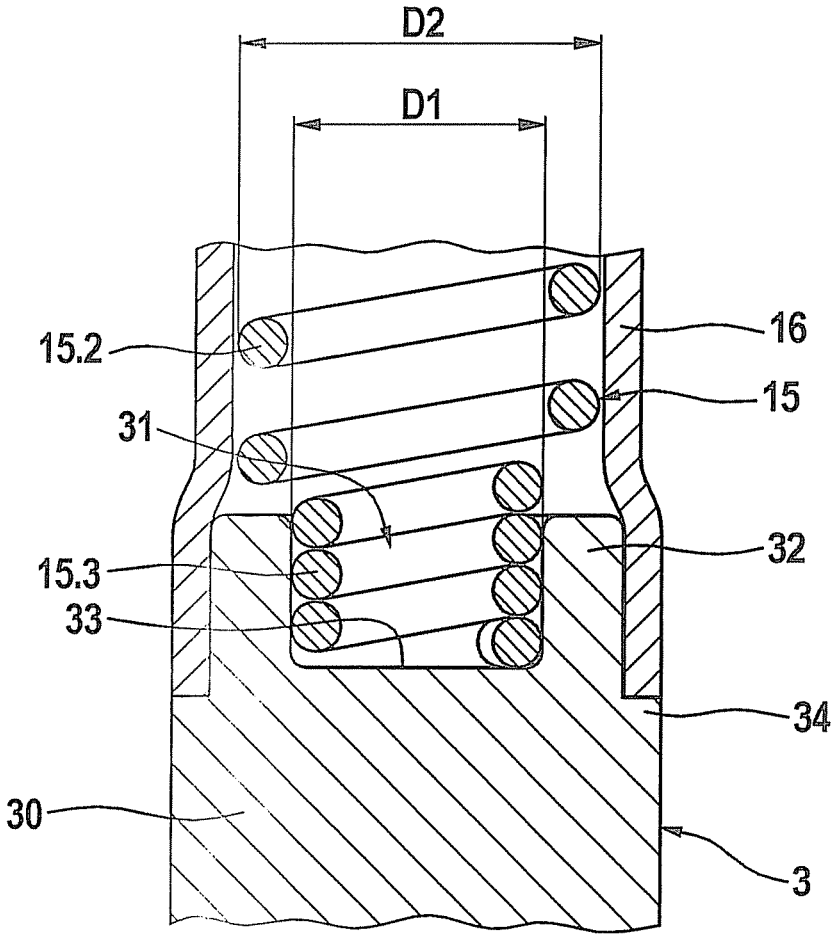
FIG. 4 shows a schematic sectional view of a contacting region between an ignition coil and a spark plug, according to a second exemplary embodiment of the present invention.

As is apparent from FIG. 4, the second exemplary embodiment substantially corresponds to the first exemplary embodiment, but in contrast to the first exemplary embodiment, in the second exemplary embodiment, recess 31 is not conical, but cylindrical. Accordingly, contact segment 15.3 of spring 15 is also formed in such a manner, that the windings of the spring of contact segment 15.3 form a cylindrical enveloping surface. Consequently, contact segment 15.3 has a cylindrical enveloping surface having a diameter D1, which is less than a diameter D2 of the remaining segments of spring 15. In this context, a diameter of recess 31 is selected so that contact segment 15.3 is seated relatively rigidly and securely in recess 31. Wall region 32 again provides shielding of the end of the spring, without additional space being necessary for this. Recess 31 of the second exemplary embodiment may be produced in a particularly simple and cost-effective manner. By rounding off the edges of wall region 32 that are oriented in the direction of the ignition coil, a certain amount of aid in centering may also be provided during assembly. The windings of contact segment 15.3 of the spring are likewise in contact with one another, so that particularly effective contacting may be achieved. In all other respects, this exemplary embodiment is equivalent to the preceding exemplary embodiment, so that reference may be made to the description provided for it.

What is claimed is:

1. An ignition coil for connection to a spark plug, comprising:

a high-voltage terminal; and a spring electrically connecting the high-voltage terminal to the spark plug, wherein the spring has a contact segment which is directed towards the spark plug, and wherein the contact segment has an outer circumference smaller than an outer circumference of remaining segments of the spring, wherein the windings of the contact segment are formed to be non-compressible and are in contact with one another, and wherein the contact segment is designed to be shielded in the radial direction by means of a recess, provided in a contact region of the spark plug and having an annular wall region.

2. The ignition coil as recited in claim 1, wherein the contact segment of the spring is tapered in the direction of the end of the spring.

3. The ignition coil as recited in claim 2, wherein the contact segment of the spring is conically tapered at an opening angle between 40° and 60°.

4. The ignition coil as recited in claim 1, wherein the contact segment of the spring is substantially cylindrical and has an outer diameter less than an outer diameter of remaining segments of the spring.

5. The ignition coil as recited in claim 1, wherein the contact segment includes one of (i) exactly two windings or (ii) exactly three windings.

6. A spark plug, comprising:

a contact region for contacting with a spring of an ignition coil, wherein the contact region has a recess surrounded by a closed, annular wall region for receiving a contact segment of the spring of the ignition coil, wherein the annular wall region is designed to shield the contact segment of the spring, and wherein the exterior of the annular wall region has a shoulder region for receiving a protective sheath of the ignition coil.

7. The spark plug as recited in claim 6, wherein the recess is tapered in a direction of a center line of the spark plug.

8. The spark plug as recited in claim 7, wherein the recess is conically tapered at an opening angle between 40° and 60°.

9. The spark plug as recited in claim 6, wherein the recess is cylindrical.

10. The spark plug as recited in claim 6, wherein the recess has a depth which is at least equal to a diameter of the spring wire of the spring of the ignition coil.

11. The spark plug as recited in claim 6, wherein the recess at least one of (i) has a circular base region, and (ii) is concentric with respect to a center line of the spark plug.

12. The spark plug as recited in claim 6, wherein the annular wall region has a minimum thickness which is at least equal to a diameter of spring wire of the spring of the ignition coil.

13. An ignition unit, comprising:

a spark plug;

an ignition coil having a high-voltage terminal and a spring;

wherein:

the spring electrically connects the high-voltage terminal to the spark plug;

the spring has a contact segment which is directed towards the spark plug, the contact segment having an outer circumference smaller than an outer circumference of remaining segments of the spring, wherein the windings of the contact segment are formed to be non-compressible and are in contact with one another;

the spark plug has a contact region for contacting with the ignition coil, the contact region having a recess which has an annularly closed wall region, wherein the annularly closed wall region is designed to shield the contact segment of the spring; and the contact segment of the spring of the ignition coil is situated in the recess of the contact region of the spark plug.

14. The ignition unit as recited in claim 13, wherein the shape of the recess is complementary to the shape of an enveloping surface of the contact segment of the spring of the ignition coil.

15. The ignition unit as recited in claim 13, wherein a depth of the recess of the spark plug is at least two times greater than a diameter of spring wire of the spring.

16. The ignition unit as recited in claim 13, wherein the contact segment of the spring of the ignition coil exclusively contacts the wall region of the recess.

17. The ignition coil as recited in claim 3, wherein the contact segment of the spring is conically tapered at an opening angle of 50°.

18. The ignition coil as recited in claim 1, wherein the contact segment has an outer circumference between 0.3 and 0.5 mm.

19. The ignition coil as recited in claim 18, wherein the contact segment has an outer circumference of 0.4 mm.

20. The ignition coil as recited in claim 1, wherein the spring has a spring wire diameter between 0.5 mm and 0.8 mm.

21. The ignition coil as recited in claim 20, wherein the spring wire diameter is 0.6 mm.

22. The spark plug as recited in claim 10, wherein the recess has a depth which is between two to three times greater than the diameter of the spring wire of the spring of the ignition coil.

23. The spark plug as recited in claim 6, wherein the recess has a depth between 1.2 mm and 1.6 mm.

24. The spark plug as recited in claim 6, wherein the recess has a depth of 1.5 mm.

* * * * *